United States Patent [19]

Harrington

[11] Patent Number: 4,467,492

[45] Date of Patent: Aug. 28, 1984

[54] TROWEL TYPE CONSTRUCTION TOOL

[76] Inventor: Eugene M. Harrington, 3672 Holboro Dr., Los Angeles, Calif. 90027

[21] Appl. No.: 481,991

[22] Filed: Apr. 4, 1983

[51] Int. Cl.[3] ..... B05C 17/10; E04F 21/16

[52] U.S. Cl. ..... 15/235.4; 15/143 R

[58] Field of Search ..... 15/235.4, 235.5, 235.6, 15/235.7, 235.8, 143 R; 264/259

[56] References Cited

U.S. PATENT DOCUMENTS

| | | | |
|---|---|---|---|
| 850,945 | 4/1907 | Martin | 15/235.4 |
| 3,346,905 | 10/1967 | Scarpelli | 15/235.6 |

FOREIGN PATENT DOCUMENTS

| | | | |
|---|---|---|---|
| 42971 | 1/1982 | European Pat. Off. | 15/235.4 |
| 2001072 | 7/1971 | Fed. Rep. of Germany | 15/235.4 |
| 1076525 | 7/1967 | United Kingdom | 15/235.4 |

*Primary Examiner*—Chris K. Moore

*Attorney, Agent, or Firm*—William W. Haefliger

[57] ABSTRACT

A trowel type construction tool comprises (a) a metal blade extending longitudinally and generally horizontally, (b) a longitudinally extending metallic rib attached to the upper side of the blade, (c) a metallic strut having (i) a lower portion integral with the rib (ii) an upstanding intermediate portion (iii) a generally horizontally extending upper portion, (d) solid synthetic resinous material molded about said strut upper portion to form a handle.

8 Claims, 7 Drawing Figures

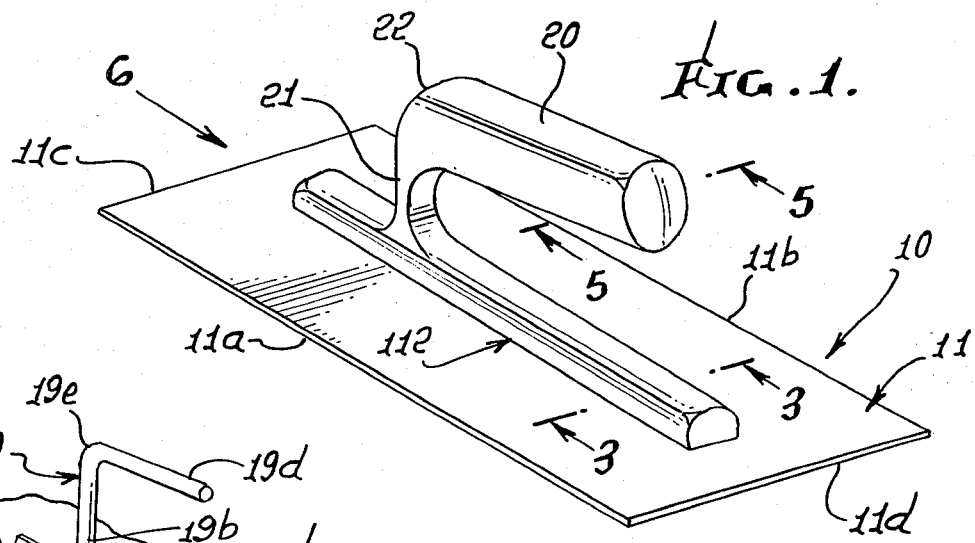
FIG. 1.
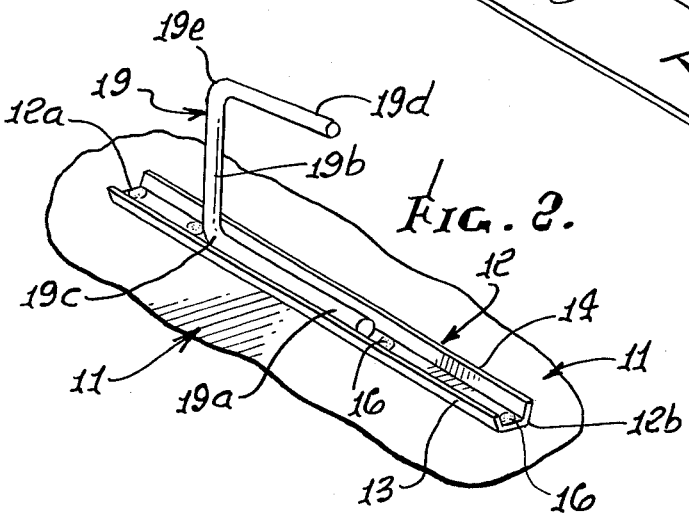
FIG. 2.
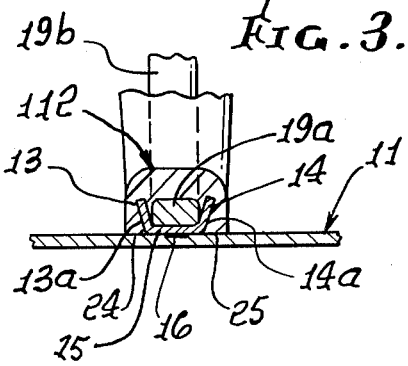
FIG. 3.
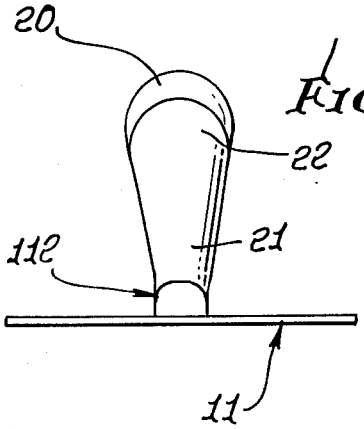
FIG. 6.
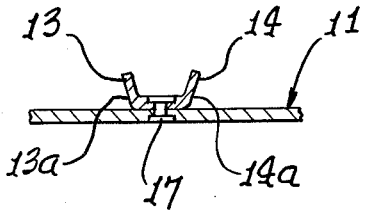
FIG. 4.
FIG. 5.
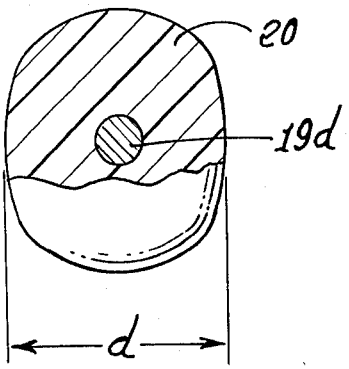
FIG. 7.
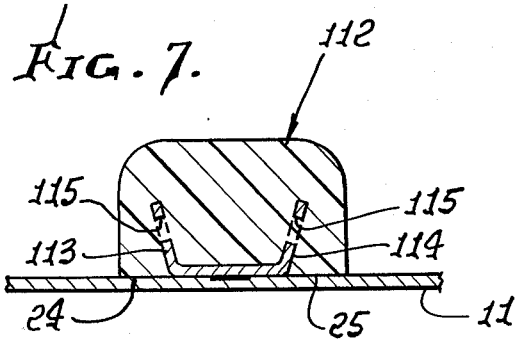

TROWEL TYPE CONSTRUCTION TOOL

BACKGROUND OF THE INVENTION

This invention relates generally to hand tools, and more particularly to a trowel type construction tool.

Desirable characteristics of trowels include simple, rugged and durable construction, and hand protecive features, whereby the user's hand is not injured during inadvertent misgrasping of the tool above the blade. Prior tools of this type have employed aluminum or steel shanks but they could break, or separate from the blade.

SUMMARY OF THE INVENTION

It is a major object of the invention to provide a trowel type construction tool which embodies the above desirable characteristics, and eliminates the above undesirable features of prior tools. Basically, the present tool is characterized by:

(a) a metal blade extending longitudinally and generally horizontally, (b) a longitudinally extending metallic rib attached to the upper side of the blade, (c) a metallic strut having (i) a lower portion integral with the rib (ii) an upstanding intermediate portion (iii) a generally horizontally extending upper portion (d) solid synthetic resinous material molded about said strut upper portion to form a handle, (e) the synthetic resinous material also molded about and over the rib and said lower portion of the strut to conceal same, the metal rib having retention surfaces engaged by said material and acting to retain said material to the blade.

Additional features include, molding of the resinous material over the strut intermediate portion to join the handle and the outer molded rib that encapsulates the narrow inner metallic rib; channel flanges on the metallic rib that lock to the resinous material as by reverse draft or by penetration of resinous material into recesses in the flanges; attachment of a channel web to the blade as by welding or riveting; and engagement of the molded outer rib material with the blade to block lateral rocking of the handle relative to the blade.

These and other objects and advantages of the invention, as well as the details of an illustrative embodiment, will be more fully understood from the following specification and drawings, in which:

DRAWING DESCRIPTION

FIG. 1 is perspective view of a tool incorporating the invention;

FIG. 2 is a fragmentary perspective view of anchoring structure used in the FIG. 1 tool;

FIG. 3 is an enlarged section, taken in elevation on lines 3—3 of FIG. 1;

FIG. 4 is a view like FIG. 3, showing a modification;

FIG. 5 is a section on lines 5—5 of FIG. 1;

FIG. 6 is an end elevation taken on lines 6—6 of FIG. 1; and

FIG. 7 is an enlarged view like FIG. 3, showing a further modification.

DETAILED DESCRIPTION

In the drawings, a trowel-type construction tool 10 includes a longitudinally elongated metallic blade 11 which extends generally horizontally. Attached to the upper side of the blade is a longitudinally elongated metallic rib 12 encapsulated by an elongated non-metallic outer rib 112. Typically, these ribs are located midway between opposite edges 11*a* and 11*b* of the blade. Also, opposite ends 12*a* and 12*b* of the rib 12 are spaced at approximately equal distances from the opposite ends 11*c* and 11*d* of the blade. The rib 12 typically forms an elongated channel opening upwardly, and having two laterally spaced flanges 13 and 14 upstanding relative to the blade, as well as a narrow web 15 interconnecting the two flanges. The horizontal web is attached to the blade, as for example by spot welds 16 spaced along the web lengths. Alternatively, the web may be riveted to the blade, as at locations 17 shown in FIG. 4. FIGS. 3 and 4 also show the flanges as diverging relative to one another in an upward direction, for purposes as will appear.

A metallic support strut 19 is also provided to have a lower portion 19*a* integral with the rib 12. The portion 19*a* typically extends longitudinally in the channel between the flanges as shown, and may be welded to the rib 12. Strut 19 also includes an upstanding intermediate portion 19*b* (connected by bend 19*c* to portion 19*a*), and a generally horizontally extending upper portion 19*d* (connected by bend 19*e* to portion 19*b*). Portion 19*d* is shown to extend above portion 19*a*.

Solid synthetic resinous material (one example being polypropylene) is molded about the strut 19 upper portion to form a handle 20, between about ¾ and 1½ inches in cross dimension "d" (see FIG. 5). Such material is also molded about and over rib 12 and the lower portion 19*a* of the strut to form the outer rib 112 referred to above, and concealing rib 12 and strut portion 19*a*. In addition, the synthetic resin may be molded about the strut intermediate portion 19*b*, as at 21, to extend downwardly, and smoothly from the handle 20 via arcuate bend 22, and to integrally intersect the outer rib 112 intermediate opposite ends of the latter, whereby the entireties of the strut and inner rib 12 are concealed by the smoothly conformed molded synthetic resin extents 20, 21 and 112, for ease of manual use, without injury to the hand.

The metallic rib 12 has retention surfaces engaged by the molded material of the outer rib and acting to retain that material to the blade. In FIGS. 3 and 4, the flanges 13 and 14 provide the retention surfaces, as at 13*a* and 14*a* which are characterized by reverse draft relative to the blade, to lock the molded outer rib 112 to the inner rib 12 and blade 11. Accordingly, force is transmissible from the handle 20 to the inner rib 12 and blade not only by the strut 19, but also by the tough molded plastic material at 21 and 112, as described. Further, lateral rocking of the handle relative to the blade is blocked by the outer rib under surfaces 24 and 25 engaging the blade top surface, laterally outwardly of the lower most extents of the flanges 13 and 14. Therefore, the two ribs 12 and 112 serve multiple functions. The attachment of rib 12 (as by welds 16) to the blade is thereby protected.

In FIG. 7, the channel flanges 113 and 114 contain recesses or openings 115 therein to receive the molded material of outer rib 112, to lock that material to the inner rib 12, whereby the anti-rocking engagements at 24 and 25 are preserved.

A simple, rugged, durable and hand-protective tool is thereby provided.

I claim:

1. In a trowel type construction tool, the combination comprising (a) a metal blade extending longitudinally and generally horizontally, (b) a longitudinally extending metallic rib attached to the upper side of the blade, (c) a metallic strut having (i) a lower portion integral with the rib (ii) an upstanding intermediate portion (iii) a generally horizontally extending upper portion, (d) solid synthetic resinous material molded about said strut upper portion to form a handle, (e) the synthetic resinous material also molded about and over the rib and said lower portion of the strut to conceal same, the metal rib having retention surfaces engaged by said material and acting to retain said material to the blade.

2. The combination of claim 1 wherein said synthetic resinous material is also molded about the strut intermediate portion to extend downwardly and externally smoothly from the handle to the material that is molded over the rib, whereby the entirety of said strut and rib are concealed by said material and the blade.

3. The combination of claim 1 wherein the rib forms an elongated channel having two flanges upstanding relative to the blade and a web interconnecting the flanges and attached to the blade, the strut lower portion extending lengthwise in the channel and attached thereto.

4. The combination of claim 3 wherein the channel flanges diverge upwardly relative to one another, providing said retention surfaces with reference draft relative to the blade.

5. The combination of claim 3 wherein the channel flanges have openings therein to receive said molded material.

6. The combination of claim 3 wherein the channel web is welded to the blade, and said molded material extends in the channel between the flanges and also outside the channel adjacent the flanges and into adjacency to the blade.

7. The combination of claim 3 wherein the channel web is riveted to the blade, and said molded material extends in the channel between the flanges and also outside the channel adjacent the flanges and into adjacency to the blade.

8. The combination of claim 1 wherein said material consists of polypropylene.

* * * * *